US008316667B2

(12) United States Patent
Huynh

(10) Patent No.: US 8,316,667 B2
(45) Date of Patent: Nov. 27, 2012

(54) GEMSTONE SETTING INCLUDING A GEM FACETED TO DISPLAY A PLURALITY OF IMAGES FROM AN OUTER FOCAL REGION

(76) Inventor: Chi Huynh, San Dimas, CA (US)

( * ) Notice: Subject to any disclaimer, the term of this patent is extended or adjusted under 35 U.S.C. 154(b) by 0 days.

(21) Appl. No.: 12/886,424

(22) Filed: Sep. 20, 2010

(65) Prior Publication Data

US 2011/0041555 A1 Feb. 24, 2011

Related U.S. Application Data

(63) Continuation of application No. 11/703,564, filed on Feb. 7, 2007, now abandoned.

(51) Int. Cl.
*A44C 17/00* (2006.01)

(52) U.S. Cl. ..... 63/33; 63/26; 63/27

(58) Field of Classification Search ..... 63/26, 27, 63/29.1, 29.2, 30–31, 33; 359/831; D11/26, D11/90–91; 362/328, 333
See application file for complete search history.

(56) References Cited

U.S. PATENT DOCUMENTS

| | | | | |
|---|---|---|---|---|
| 1,392,604 | A | 10/1921 | Smith | |
| 2,447,407 | A * | 8/1948 | Grain | 63/32 |
| 2,511,510 | A | 6/1950 | Mukai | |
| 2,535,807 | A | 12/1950 | Moyd | |
| 2,596,965 | A * | 5/1952 | Troy | 2/239 |
| 3,528,261 | A | 9/1970 | Jones | |
| 3,808,836 | A | 5/1974 | Jones | |
| 3,835,665 | A | 9/1974 | Kitchel | |
| 4,809,417 | A | 3/1989 | Normann, Jr. | |
| 4,936,115 | A | 6/1990 | Mesica | |
| D315,698 | S | 3/1991 | Abraham | |
| 5,454,234 | A | 10/1995 | Karmeli | |
| D370,642 | S | 6/1996 | Stafford | |
| 5,632,164 | A * | 5/1997 | Bergagnini | 63/23 |
| 5,664,440 | A | 9/1997 | Roemer | |
| 5,868,008 | A | 2/1999 | Yamaura | |
| D412,681 | S | 8/1999 | Canale | |
| 6,012,302 | A | 1/2000 | Hurwitz | |
| D432,938 | S | 10/2000 | Vardakis | |
| D439,191 | S | 3/2001 | Wolf | |
| 6,298,689 | B1 | 10/2001 | Lai | |
| 6,430,963 | B1 | 8/2002 | Friedman | |
| 6,553,786 | B1 | 4/2003 | Kwiat | |
| 6,649,009 | B1 | 11/2003 | Kim | |
| 6,782,715 | B2 | 8/2004 | Ruth | |
| D507,506 | S | 7/2005 | Chan | |
| 7,104,089 | B2 | 9/2006 | LaCroix | |

(Continued)

FOREIGN PATENT DOCUMENTS

WO 2005/025365 3/2005

*Primary Examiner* — Jack W. Lavinder
*Assistant Examiner* — Abigail E Morrell
(74) *Attorney, Agent, or Firm* — Biotech Beach Law Group PC

(57) ABSTRACT

A method of manufacturing gemstone settings including a primary gem capable of displaying a plurality of images corresponding to one or more objects placed within in a focal region outside of the primary gem. The plurality of images is displayed by flattening the bottom of the primary gem and faceting the crown to specifications that allow light to pass through the gem and not substantially reflect against a faceted pavilion.

15 Claims, 14 Drawing Sheets

U.S. PATENT DOCUMENTS

| | | | | |
|---|---|---|---|---|
| 7,127,916 | B2 | 10/2006 | Ruth | |
| 2003/0177789 | A1 | 9/2003 | Leuz | |
| 2003/0188548 | A1 | 10/2003 | Matano | |
| 2004/0237585 | A1 | 12/2004 | Golden | |
| 2005/0050921 | A1* | 3/2005 | Katz et al. | 63/32 |
| 2005/0056054 | A1 | 3/2005 | Pourmehdi | |
| 2005/0193769 | A1 | 9/2005 | Ebara | |
| 2005/0274144 | A1 | 12/2005 | Goughnour et al. | |
| 2007/0209390 | A1 | 9/2007 | Malinowski | |

* cited by examiner

FIG. 11

Table of Common Gems, Composition and Refractive Index

| Gem | Composition | Refractive Index |
|---|---|---|
| Actinolite | Aphibole | 1.62-1.64 |
| Agate | $SiO_2$ | 1.53-1.54 |
| Alexandrite | $BeAl_2O_4$ | 1.741 - 1.760 |
| Amethyst | $SiO_2$ | 1.544 - 1.553 |
| Ametrine | $SiO_2$ | 1.544 - 1.553 |
| Andalusite | $Al_2SiO_5$ | 1.628 - 1.647 |
| Andexine-Labradorite | $NaAlSi_3O_8$ | 1.54 –1.55 |
| Apatite | Phosphate group | 1.63-1.64 |
| Aquamarine | $Be_3Al_2(SiO_3)6$ | 1.57-1.60 |
| Axinite | | 1.673 – 1.693 |
| Benitoite | $BaTiSi_3O_6$ | 1.757 – 1.804 |
| Beryl | $Be_3Al_2(SiO_3)6$ | 1.577-1.583 |
| Bi Color Tourmaline | $(NaCa)(LI,MgFe,Al)9B_3Si_6(O,OH)31$ | 1.624-1.644 |
| Bixbite | $Be_3Al_2(SiO_3)6$ | 1.577-1.583 |
| Calcite | $CaCO_3$ | 1.486 - 1.658 |
| Chalcedony | $SiO_2$ | 1.530 - 1.539 |
| Chrome Tourmaline | $(NaCa)(LI,MgFe,Al)9BSi_6(O,OH)31$ | 1.624-1.644 |
| Chrysoberyl | $BeAl_2O_4$ | 1.741 - 1.760 |
| Chrysoberyl Cats Eye | $BeAl_2O_4$ | 1.741 - 1.760 |
| Chrysoprase | $SiO_2$ | 1.544 - 1.553 |
| Clinohumite | Magnesium Silicate Fluoride OH | 1.625 – 1.668 |
| Danburite | calcium borosilicate | 1.630-1.636 |
| Demantoid | $Ca_3Fe_2(SiO_4)3$ | 1.888 - 1.889 |
| Diamond | C | 2.417 |
| Diopside | $CaMgSi_2O_6$ | 1.665 - 1.730 |
| Dioptase | $CuSiO_2(OH)_2$ | 1.644 – 1.709 |

FIG. 11 (continued)

| | | |
|---|---|---|
| Emerald | $Be_3Al_2(SiO_3)6$ | 1.577-1.583 |
| Enstatite | $MgSiO_3$ | 1.663-1.673 |
| Eculase | $BeAlSiO_4(OH)$ | 1.652-1.672 |
| Fire Agate | $SiO_2$ | 1.544 - 1.553 |
| Fluorite | $CaF_2$ | 1.43 |
| Grossularite | $Ca_3Al_2(SiO_4)3$ | 1.72-1.748 |
| Hemimorphite | $(Zn_4Si_2O_7(OH)2.H2O)$ | 1.612-1.633 |
| Hessonite | $Ca_3Al_2(SIO_4)3$ | 1.72-1.74 |
| Idocrase | nesosilicate or sorosilicate | 1.71 - 1.73 |
| Indicolite | $(NaCa)(LI,MgFe,Al)9B_3Si_6(O,OH)31$ | 1.624-1.644 |
| Lolite | $MG_2AL_4SI_5O_{18}$ | 1.53 - 1.55 |
| Jadeite | $NaAl(SiO_3)_2$ | 1.654 - 1.667 |
| Kornerupine | | 1.665 – 1.683 |
| Kunzite | $LiAlSi_2O_6$ | 1.660 - 1.675 |
| Kyanite | $AL_3SIO_5$ | 1.716 – 1.731 |
| Lapis | A complex aggregate | 1.50 |
| Malaia garnet | $(Mg_3 + Mn_3)AL_2(SIO_4)$ | 1.73 - 1.81 |
| Mali garnet | $Ca_3Al_2(SiO_4)3$ | 1.72-1.748 |
| Mawsitsit | | 1.52 |
| Moonstone | $KalSI_3O_8$ | 1.518 – 1.526 |
| Morganite | $Be_3Al_2(SiO_3)6$ | 1.577-1.583 |
| Oligoclase | $(Na,Ca)AlSi_3O_8$ | 1.53 - 1.54 |
| Opal | $SIO_2nH_2O$ | 1.44-1.46 |
| Peridot | $(Mg,Fe)2(SiO)4$ | 1.654-1.689 |
| Pezzottaite | | 1.604 - 1.615 |
| Phenakite | $Be_2SiO_4$ | 1.651-1.696 |
| Prehnite | $(CA_3Al_2SI_3O_{10}(OH)_2)$ | 1.61 - 1.64 |
| Quartz | $SiO_2$ | 1.544 - 1.553 |
| Rhodochrosite | $MnCO_3$ | 1.600 – 1.820 |
| Rhodolite | $Al_3(SiO_4)3$ | 1.75 - 1.77 |

FIG. 11 (continued)

| | | |
|---|---|---|
| Rubelite | (NaCa)(LI,MgFe,Al)9$B_3Si_6$(O,OH)31 | 1.624-1.650 |
| Ruby | $AL_2O_3$ | 1.759-1.778 |
| Sapphire | $AL_22O_3$ | 1.759-1.778 |
| Sapphirine | | 1.714-1.723 |
| Scapolite | | 1.54 - 1.577 |
| Scheelite | $CaWO_4$ | 1.918 - 1.937 |
| Sillimantite | $Al_2OSiO_4$ | 1.658 - 1.678 |
| Spessartite | $Mn_3Al_2(SiO_4)3$ | 1.79-1.81 |
| Sphalerite | ZnS | 2.37 |
| Sphene | $CaTiSiO_5$ | 1.885-1.990 |
| Spinel | $MgAl_2O_4$ | 1.718 |
| Star sapphire | $AL_2O_3$ | 1.759-1.778 |
| Sunstone | $NaAlSi_3O_8$ | 1.54 –1.55 |
| Taaffeite | Beryllium magnesium aluminate wi | 1.71-1.72 |
| Tanzanite | $Ca_2(Al,OH)Al_2(SIO_4)$ | 1.688 - 1.707 |
| Topaz | AL(F,OH)2$SIO_4$ | 1.629 - 1.637 |
| Tourmaline | (NaCa)(LI,MgFe,Al)9$B_3Si_6$(O,OH)31 | 1.624-1.644 |
| Tsavorite | $Ca_3Al_2(SiO_4)3$ | 1.735 |
| Turquoise | $CuAl_6(PO_4)4(OH)85H2O$ | 1.62 |
| Zircon | $ZrSiO_4$ | 1.780-1.984 |

GEMSTONE SETTING INCLUDING A GEM FACETED TO DISPLAY A PLURALITY OF IMAGES FROM AN OUTER FOCAL REGION

TECHNICAL FIELD

The present invent relates to jewelry settings for gemstones and more specifically to a gemstone setting including a primary gem faceted to display a plurality of images received from a focal region outside of the primary gem.

BACKGROUND

Gemstones are minerals obtained from the earth or in some cases developed in the laboratory. The top of the gemstone is referred to as the crown. The crown frequently has polished cut surfaces called facets for enhancing the reflective nature of the gemstone. Among these facets are the table, star facets and bezel facets. The midline of a gem is referred to as the girdle. The girdle may or may not be faceted. The area below the girdle is referred to as the pavilion. The facets around the pavilion are commonly referred to as lower girdle facets and pavilion facets. The faceted pavilion causes light entering the gemstone to reflect outward through the crown creating enhanced brilliance. Below the pavilion and at the bottom of the gemstone is the cutlet. The cutlet is typically pointed such that the pavilion maximizes internal reflection of light.

Gemstone arrangements are often constructed to enhance the appearance of precious and semi-precious gems. Frequently these arrangements are constructed to mask the quality of an inferior gem or to tint to the gem with a desired color without altering the gem's chemical composition. One such technique includes mounting a secondary gem having a desired color or reflective property in close proximity to the primary gem. The effect is a primary gem that appears to have a desired hue or an enhanced brilliance. Different specific techniques are explored in more detail below.

U.S. Pat. No. 4,809,417 by Norman, Jr. (the '417 patent) discloses a method of making a multiplet jewelry product with an internally embedded visual indicia. The methods include providing a transparent layer and a gemstone, each having an interfacial surface, affixing visual indicia to one of the interfacial surfaces by applying a coating, and securing the interfacial surfaces together. The indicia are viewed through the transparent layer. In essence the '417 patent requires fusing an image between two complementary surfaces.

U.S. Pat. No. 5,664,440 by Roemer (the '440 patent) discloses a composite ring including a band, an outermost stone comprising a diamond and a innermost stone being a colored stone. The innermost stone is placed beneath the diamond at a spacing of 0.1 mm to 2 mm. The color of the innermost stone is visible when viewing the diamond. Thus, the innermost stone tints the diamond. While the innermost stone provides a general hue for the diamond, distinct images corresponding to the innermost stone are not observed. In addition, while the diamond is tinted, the diamond retains its faceted pavilion for internal reflection of light and increased brilliance.

U.S. Pat. No. 5,868,008 by Yamaura et al (the '008 patent) discloses a jewelry ornament including a base with a hole formed in a central portion thereof, a transparent or semi-transparent gem held by a prong mount and a colored back-up gem at least partially positioned in the hole.

In essence, the '008 patent provides a setting for enhancing the gem's original color so it appears to have a higher color grade. In addition the gem retains the faceted pavilion commonly observed with gemstones for brilliance and sparkle.

U.S. Pat. No. 6,782,715 by Ruth (the '715 patent) discloses a primary gem including a brilliant cut diamond and a plurality of at least four complementary gems including a brilliant cut diamond. The complementary gems are positioned to reflect light lost by the primary diamond. In essence, the '715 patent discloses a gemstone setting where a set of complementary diamonds return light that was not correctly reflected by the diamond's faceted pavilion. Thus, the '715 patent discloses a setting to mask imperfections in the faceted pavilion and to enhance the brilliance of the brilliant cut diamond.

In view of the above referenced U.S. patents, there remains a need to develop a gemstone setting that displays a plurality of images corresponding to an object positioned in a focal region outside of the gem. The above inventions, some of which add a hue of color, focus light within the gemstone using a faceted pavilion to obtain the brilliance commonly associated with gemstone faceting.

SUMMARY

In contrast to current gemstone faceting techniques, the present invention does not seek to maximize brilliance by faceting the pavilion. Instead, the present invention utilizes a flat bottom and a faceted crown cut to specifications that display a plurality of images. In the preferred embodiment each facet displays an image generated from or corresponding to a colored object positioned outside of the gem. Therefore, when viewing the gemstone settings of the present invention, a plurality of images will be viewed.

In one aspect of the present invention a gemstone setting is disclosed, including a substantially transparent primary gem including a flat bottom and a faceted top, the faceted top faceted to display a plurality of images from a focal region outside of the primary gem and a colored object positioned within the focal region. In one embodiment the colored object is one or more secondary gems also referred to as a set of secondary gems. Thus, the primary gem displays a plurality of images that mimic or correspond to distinct features of the colored object or the secondary gems such as color, shape, partial shape and the like. Examples of gems that may be used with the present invention are precious or semi-precious gems. As nonlimiting examples, the following gems may be used with the present invention as a primary gem or as a secondary gem: an agate, an alexandrite, an amber, an ametrine, an amethyst, an aquamarine, an apatile, a beryl, a bloodstone, a chrysoberyl or cat-eye, a citrine, a corundum, a chalcedony, a chysocolla, a coral, a diamond, an emerald, a green beryl, a garnet, a quartz, a lolite, a jadcite, a kupzite, a lapis lazuli, a moonstone, a malachite, a moamite, an onyx, an opal, a pearl, a peridot, a red corundum, a ruby, a sardonyx, a sapphire, a spessartime, a sphene, a spinel, a star ruby and sapphiren, a sunstone, a tanzanite, a tiger eye, a tourmaline, a topaz, a turquoise, a tsavorite, and a zircon.

In one embodiment the faceted top includes at least three facet angles. As a nonlimiting example, the second facet angle is above the first and the third is above the second. The facets display a plurality of images, which may correspond to one or more different colors, one or more typographical symbols, a picture or portion thereof. In some embodiments the plurality of images are projected outward from the faceted top to create an appearance that the plurality of images are floating in space.

The focal region of the primary gem is positioned outside, such as but not limited to vertically beneath and horizontally about the center of the primary gem. The focal region may be less than half of the area of the primary gem, less than 25% of the area of the primary gem, less than 10% of the area of the primary gem and the like.

In another aspect of the present invention a gemstone setting is disclosed including a substantially transparent primary gem including a flat bottom and a faceted top. The majority or more preferably each of the facets of the facet top is faceted to receive an image from a single focal region positioned outside of the primary gem. The setting also includes a colored object positioned in the single focal region such that a plurality of images corresponding to the colored object is displayed via the faceted top.

In another aspect of the present invention a gemstone setting is provided, including a substantially non-reflective primary gem having a faceted top and a flat bottom, wherein the facets of the faceted top are optically aligned such that an optical path vector from any two of the facets intersect beneath the primary gem, and an object optically aligned with the primary gem such that the faceted top displays a plurality of images corresponding to the object.

In another aspect of the present invention a method of producing a gemstone setting is provided including providing a substantially transparent primary gem and a set of colored secondary gems, the primary gem having a flat bottom; assigning a focal region beneath the primary gem for placement of the colored secondary gems; faceting the top of the primary gem to receive an image within the focal region; and permanently positioning the primary gem above the secondary colored gems such that the colored secondary gems remain in the focal region.

BRIEF DESCRIPTION OF THE DRAWINGS

FIG. 3 is a photograph depicting assembly of the gemstone setting 10.

FIG. 10 is a series of photographs of top plan views of a faceted primary gem 12 demonstrating the displayed plurality of images may shift or change depending on the viewer's orientation to the primary gem 12. The colored objects 14 placed within the focal region include four geometrically shaped colored objects: yellow 14*y*, red 14*r*, blue 14*b* and green 14*g*, the layout of which is also depicted next to the faceted primary gem 12.

FIG. 11 is a nonlimiting table of gems that may be used with the present invention. Also provided is the general composition and the refractive index.

DETAILED DESCRIPTION

This invention may be embodied in many different forms and should not be construed as limited to the embodiments set forth herein. Rather, these embodiments are provided as guidance for one skilled in the art to which the present invention belongs.

I. Definitions:

The term "substantially transparent" as used herein refers to a property of a gem that permits an image or a colored image to be viewed or projected through the gem. A substantially transparent gem is not opaque.

The term "plurality of images" as used herein refers to the display of more than one distinct or identifiable image or color. In contrast to a tinted gem that colors the entire facet, a plurality of images allow the viewing of distinct images which may include an observable border or characteristic not commonly associated with tinting. In the preferred embodiment each facet displays an image corresponding to the colored object, or portion thereof, placed within the focal region. The plurality of images may include multiple copies of the same image, or portions thereof, or may include images of different colored objects. The colored object, which is be projected or viewed through the facets, is provided in a focal region outside of the primary gem.

The term "focal region" as used herein refers to the three dimensional region outside of the primary gem where colored objects (e.g. indicia, typographical symbols, secondary gems) are placed for forming a plurality of images viewable when viewing the primary gem.

The term "optical path vector" as used herein refers to the path or vector in which a light ray would pass through space and the primary gem. The optical path vectors of the present invention are not reflected internally by faceted pavilions, but traverse the gem according to the gem's refraction index, faceted crown or top and flat bottom.

II. Gemstone Settings that Display a Plurality of Images

Figure 1:
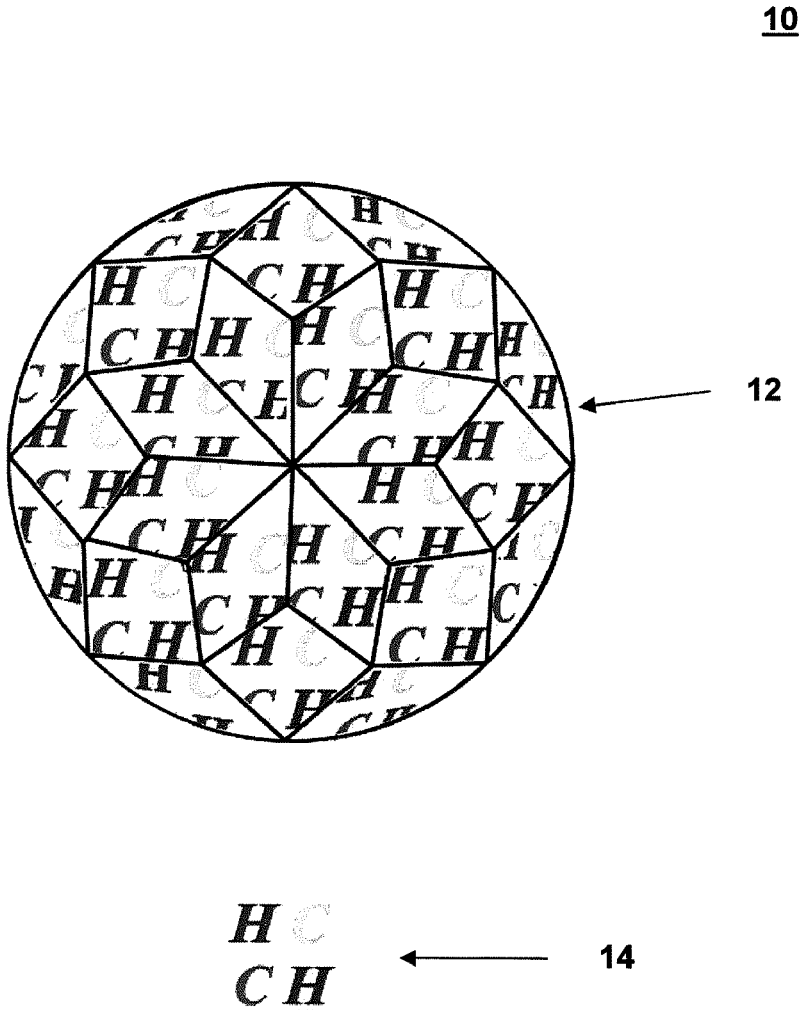
FIG. 1 is a representation of a gemstone setting 10 including a primary gem 12 displaying a plurality of images corresponding to a colored object 14.
Figure 2A:
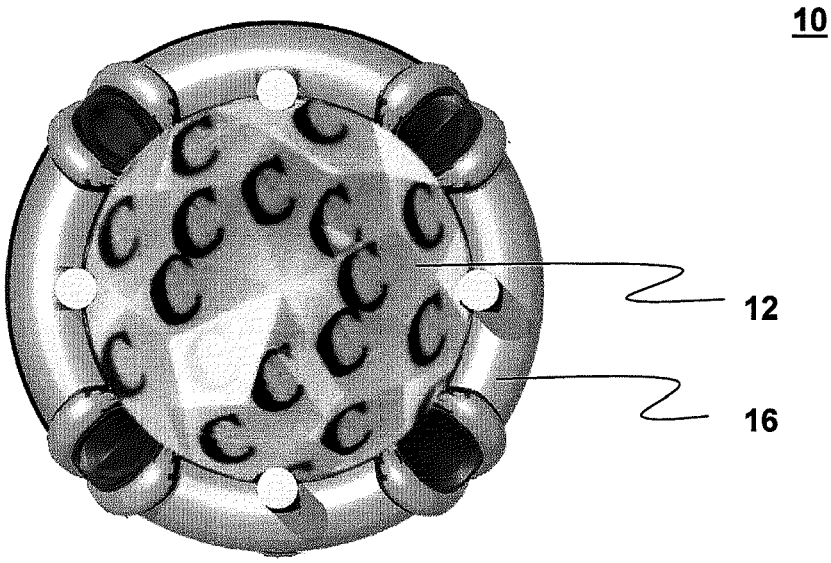
FIG. 2 is a top plan view of a gemstone setting 10 including a primary gem 12 displaying a plurality of images housed in a setting structure 16. The primary gem 12 in FIG. 2A is displaying a plurality of images including the letter "C" and the primary gem 12 in FIG. 2B is displaying a plurality of images including the letters "CH", or portions thereof.
Figure 2B:
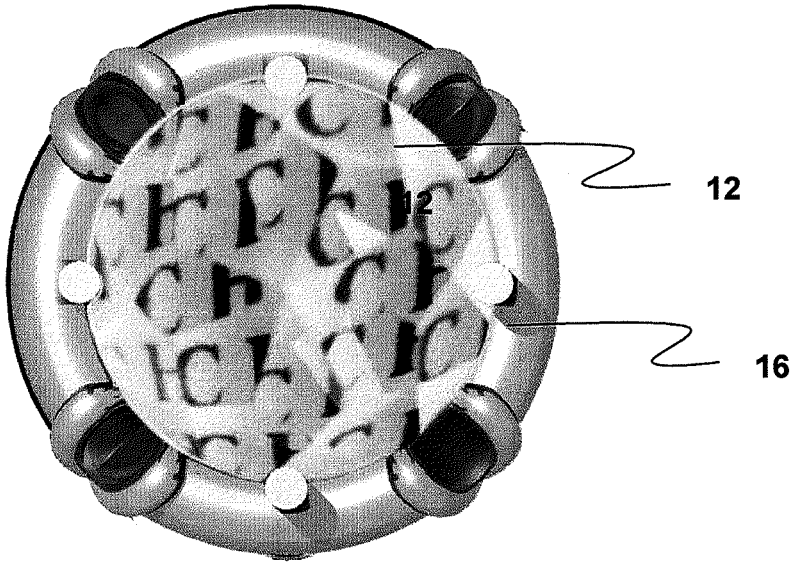
Figure 3A:
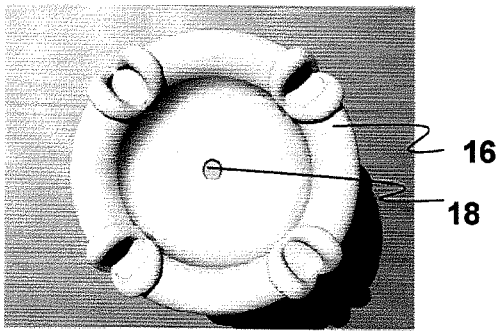
FIG. 3A is a top plan view showing a setting structure 16 having an aperture 18 for mounting to a desired jewelry item.
Figure 3B:
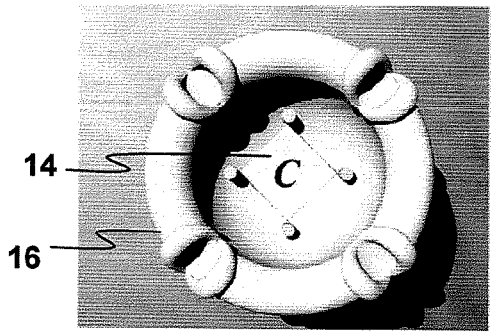
FIG. 3B is a top plan view showing the step of positioning a colored object 14 having the letter "C" in the focal region.
Figure 3C:
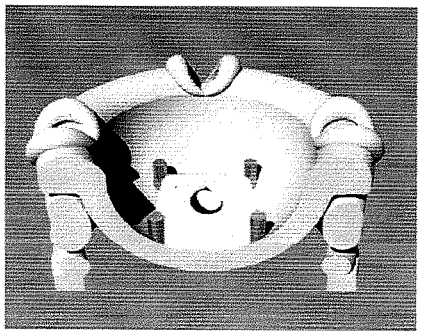
FIG. 3C is a perspective cutaway view of FIG. 3B.
Figure 3D:
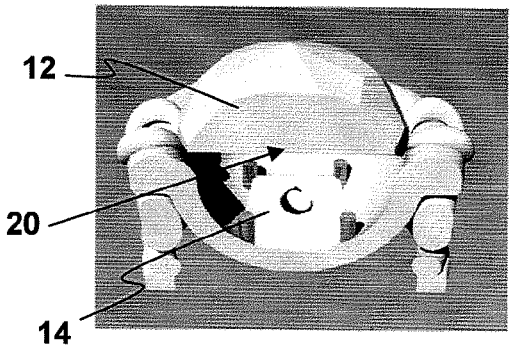
FIG. 3D is a perspective cutaway view depicting a faceted primary gem 12 positioned above the colored object 14. The flat bottom 20 is also depicted.
Figure 3E:
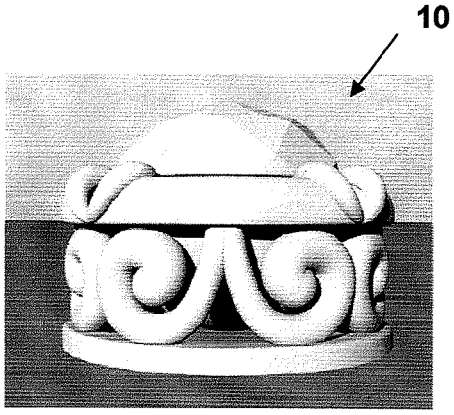
FIG. 3E is a side elevational view of an assembled gemstone setting 10.
Figure 3F:
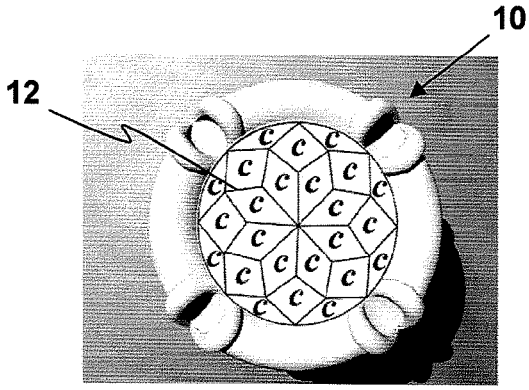
FIG. 3F is a top view of the gemstone setting 10 depicting a plurality of images that correspond to the colored object 14 placed in the focal region of the primary gem 12.
Figure 4A:
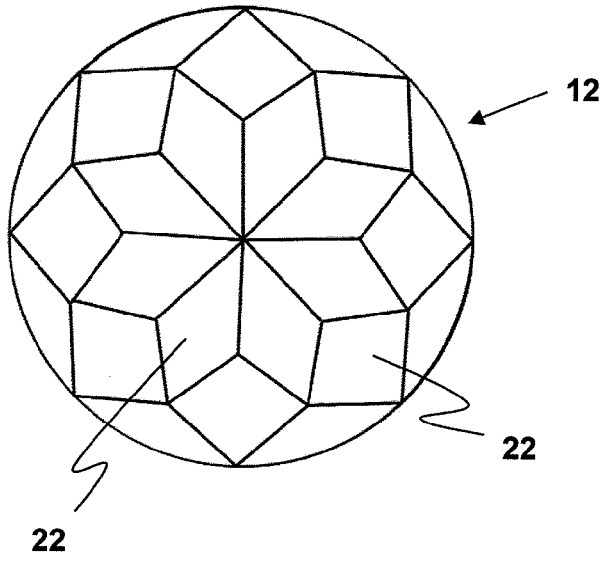
FIG. 4A is a top plan view of a faceted primary gem 12 showing multiple individual facets 22.
Figure 4B:
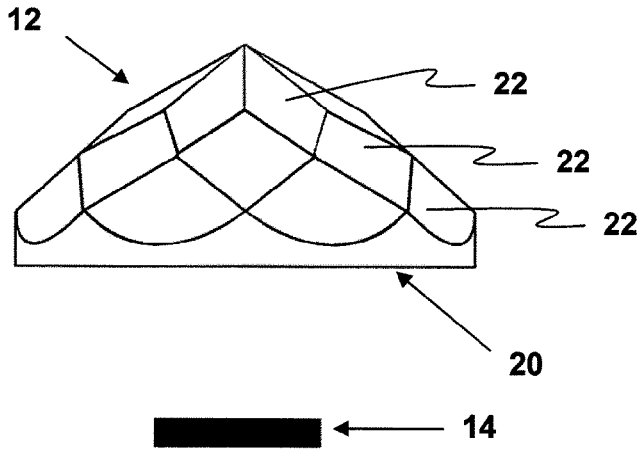
FIG. 4B is an elevational side view of the faceted primary gem 12 shown in FIG. 4A showing a flat bottom 20, multiple facets 22 and the general positioning of a colored object 14.
Figure 5A:
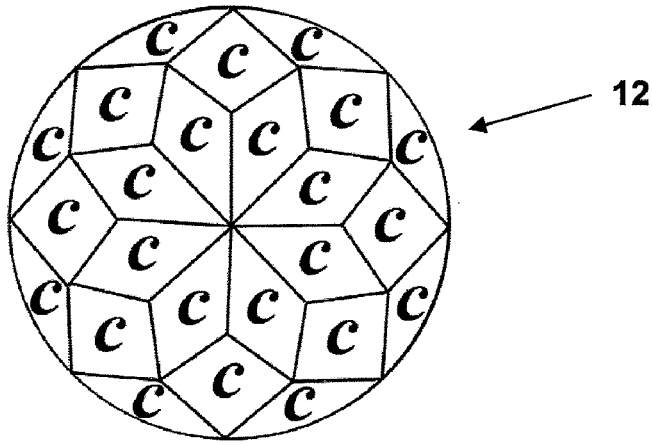
FIG. 5A is a top plan view of a faceted primary gem 12 displaying a plurality of images depicting the letter "C.
Figure 5B:
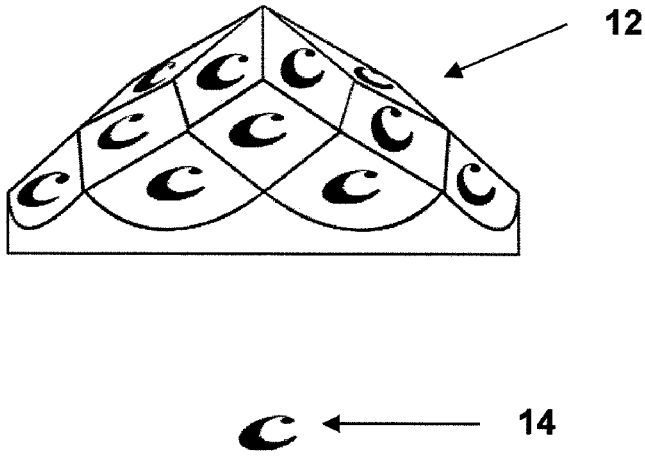
" FIG. 5B is a side elevational view of the primary gem 12 shown in FIG. 5A demonstrating the plurality of images correspond to a single colored object 14 positioned outside of the primary gem 12.
Figure 6A:
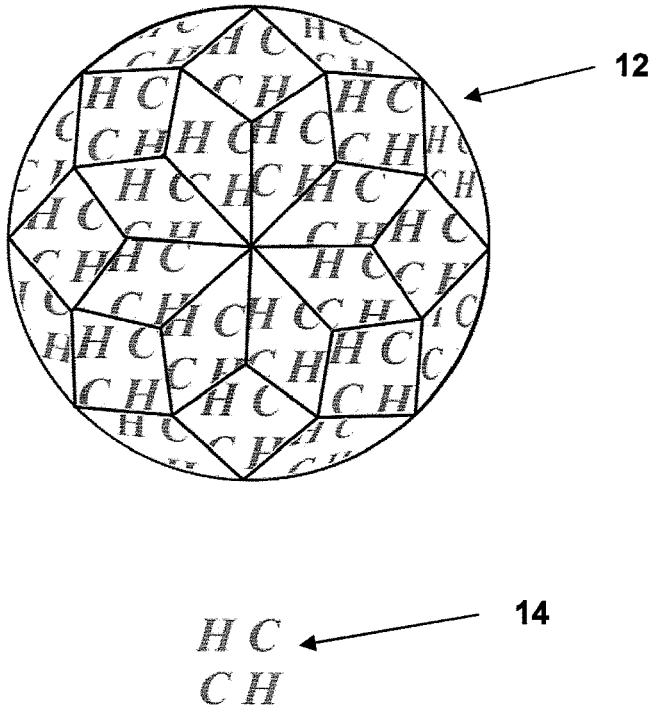
FIG. 6A is a top plan view of a faceted primary gem 12 displaying a plurality of images depicting the letters "CH." Also shown in FIG. 6A is a colored object 14 including diagonal arrangement of the letters "CH" used to generate the plurality of images.
Figure 6B:
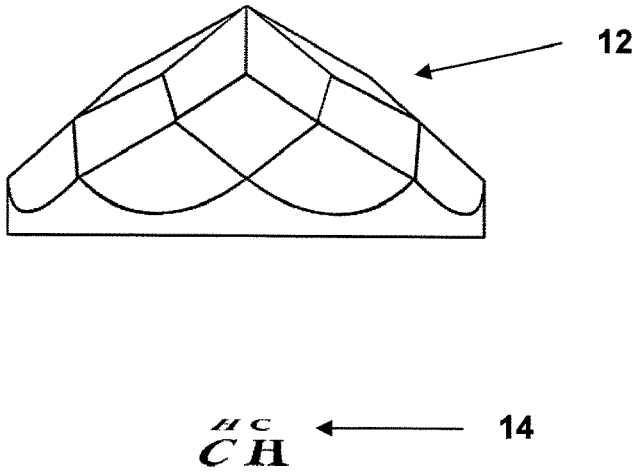
FIG. 6B is a side elevational view of the primary gem 12 (without showing the plurality of images) and a prospective view of the approximate positioning of the colored object 14 including the diagonally aligned letters "CH."
Figure 7A:
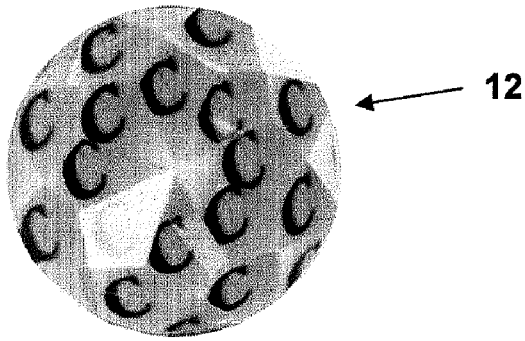
FIG. 7A is a photograph depicting a top plan view of the primary gem 12 displaying a plurality of images that correspond to the letter "C.
Figure 7B:
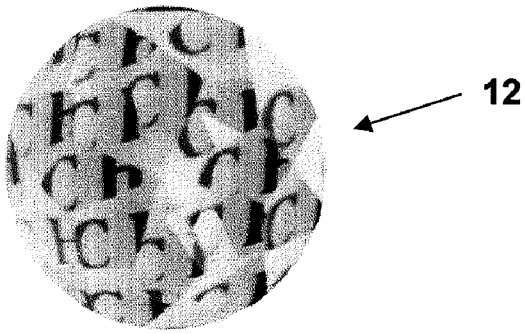
" FIG. 7B is a photograph depicting a top plan view of the primary gem 12 displaying a plurality of images that correspond to the letters "CH" or portions thereof.
Figure 8A:
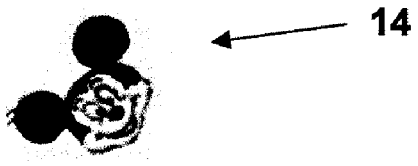
FIG. 8A is a top plan view of a colored object 14 having a picture of Mickey Mouse printed thereon.
Figure 8B:
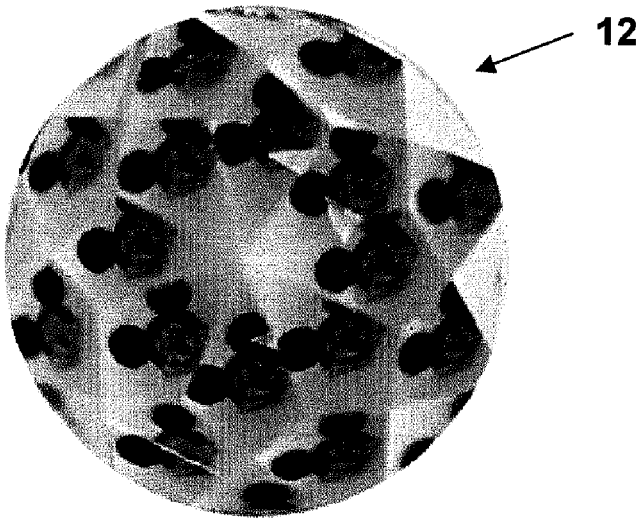
FIG. 8B is a top plan view of a primary gem 12 displaying a plurality of images corresponding to the colored object 14 shown in FIG. 8A.
Figure 9:
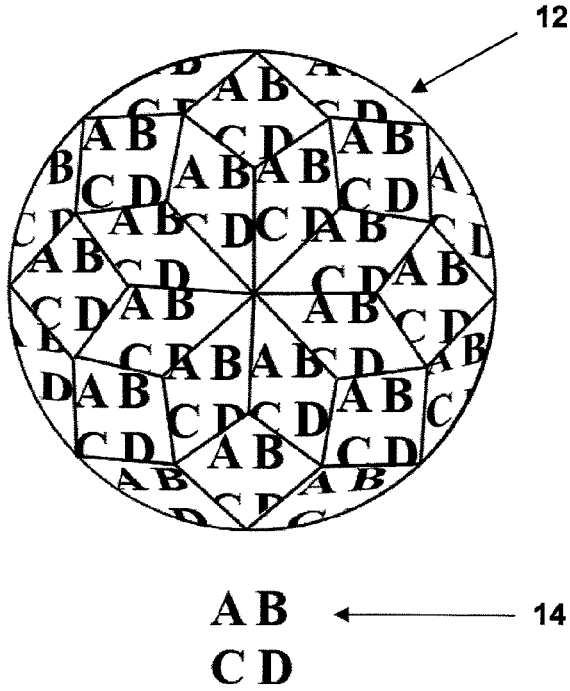
FIG. 9 is a top plan view of a primary gem 12 displaying a plurality of images A, B, C and D and the layout of the corresponding colored objects 14 depicting the letters "A, B, C and D" diagonally arranged.
Figure 10A:
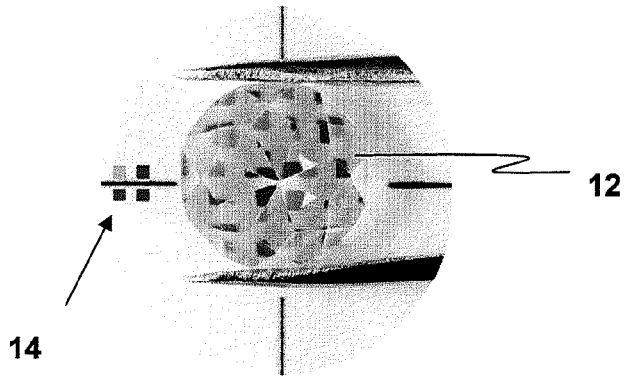
FIG. 10A depicts the faceted gem 12 displaying each of the four colored objects 14.
Figure 10B:
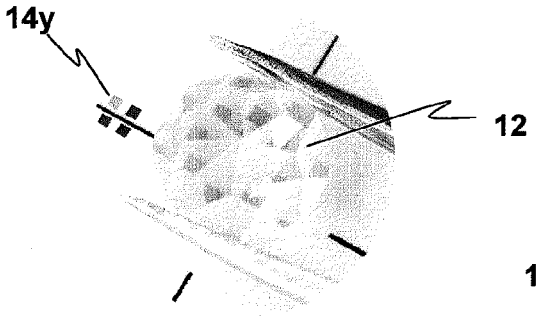
FIG. 10B is the faceted gem shown in FIG. 10A rotated counterclockwise such that the majority of facets display a yellow image corresponding to the yellow object 14*y*.
Figure 10C:
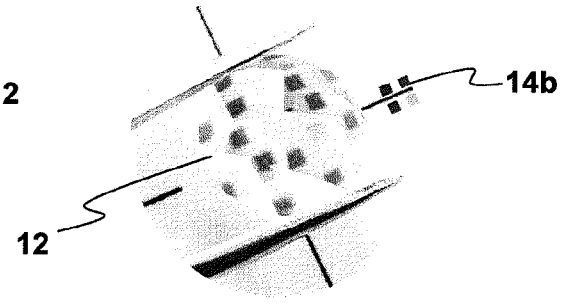
FIG. 10C is the faceted gem shown in FIG. 10B further rotated such that the majority of facets display a blue image corresponding to the blue colored object 14*b*.
Figure 10D:
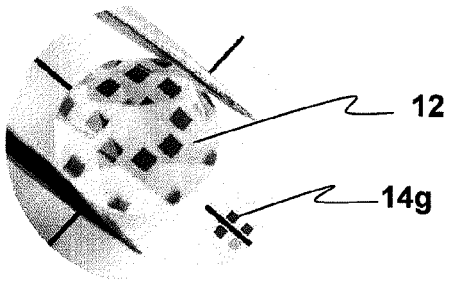
FIG. 10D is the faceted gem 12 shown in FIG. 10C further rotated such that the majority of facets display a green image corresponding to the green colored object 14*g*.
Figure 10E:
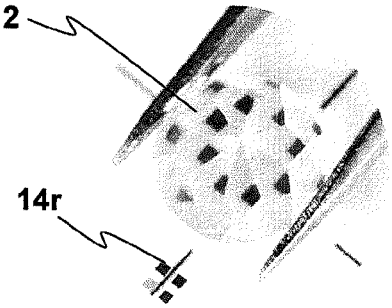
FIG. 10E is the faceted gem shown in FIG. 10D further rotated such that the majority of the facets display an red image corresponding to the red colored object 14*r*.

Referring to FIGS. 1-3, the gemstone settings 10 of the present invention include a primary gem 12 faceted to display a plurality of images. The plurality of images are distinct or identifiable images that correspond to one or more colored objects 14 or portions thereof, which are positioned within a focal region outside of the primary gem 12. The appearance may include defined boundaries or spacing between objects 14. The primary gem 12 and colored objects 14 are held in place by attachment to a structural casting or setting structure 16, which can then be attached to any conventional jewelry item such as but not limited to a ring, a pendant, a pin, a necklace, a bracelet and the like. Attachment may be further stabilized by providing an aperture 18 for desired alignment or attachment. The colored object 14 is placed vertically beneath the primary gem 12 at a distance that allows the facets 22 to focus on one or more particular areas of the object 14, thus displaying a plurality of images.

In conventional gemstone settings, the gem has a faceted crown or top and a faceted pavilion. This configuration is designed to reflect incoming light against the facet pavilion and to direct the light outwards through the crown. The term "critical angle" is known to those skilled in the jewelry arts to be the angle in which there will be total internal reflection. In fact, studies indicate the maximum brilliance of a gem is obtained when a step cut crown is used in combination with a brilliant cut pavilion.

Now referring to FIGS. 4-10, the present invention utilizes a primary gem 12 with a faceted top also referred to herein as a facet gem 12 and substitutes a faceted pavilion with a flat bottom 20. The substitution of a flat bottom 20 prevents substantial internal reflection within the primary gem 12. Thus, by eliminating or reducing the facets on a pavilion, the flat bottom 20 permits light rays to be directed through the gemstone 12. As can also be seen by FIGS. 4-10, each facet 22 may display a singe image corresponding to a single object 14 or display an image corresponding to multiple objects 14. Moreover the one or more of the plurality of images may appear to shift, vanish or appear when viewing the primary gem 12 at variable angles. One or more of the plurality of images may appear to float above the gem 12 such as an image projected outside and generally above the gem 12.

As will now be envisioned by one skilled in the jewelry arts, the primary gem 12 can be any gem that is substantially transparent such that an image may be projected or visually observed when viewing the primary gem 12. Non-limiting examples of gems that may be used with the present invention include, but are not limited to an agate, an alexandrite, an amber, an ametrine, an amethyst, an aquamarine, an apatile, a beryl, a bloodstone, a chrysoberyl or cat-eye, a citrine, a corundum, a chalcedony, a chysocolla, a coral, a diamond, an emerald, a green beryl, a garnet, a quartz, a lolite, a jadcite, a kupzite, a lapis lazuli, a moonstone, a malachite, a moamite, an onyx, an opal, a peridot, a red corundum, a ruby, a sardonyx, a sapphire, a spessartime, a sphene, a spinel, a star ruby and sapphiren, a sunstone, a tanzanite, a tiger eye, a tourmaline, a topaz, a turquoise, a tsavorite, and a zircon. The desired gem may vary between individuals and may be affected in part by the refraction index of the particular gem. A table of gems, their general composition and their refractive index are provided as FIG. 11, each of which is incorporated as part of the present invention.

Figure 12:
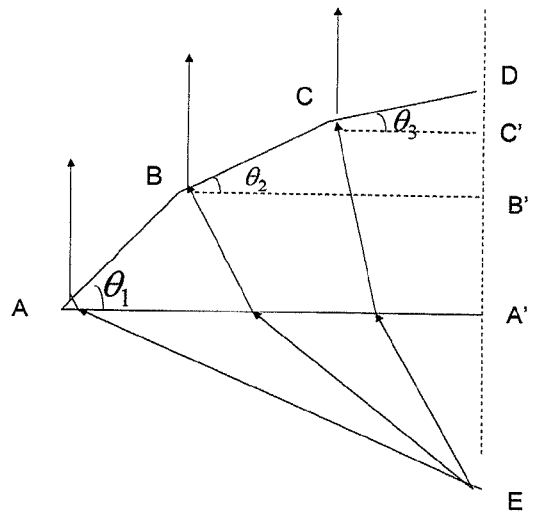
FIG. 12 is an image depicting three facets on a primary gem. Each of the three facets have different angles ($\theta_1$, $\theta_2$, $\theta_3$) and a focal region depicted as E.

The top or crown of the primary gem 12 is faceted to display a plurality of images corresponding to an object 14 positioned within the focal region. The focal region is the region in which the object(s) 14 are positioned such that they can be displayed by the primary gem 12. As shown in FIG. 12 and labeled "E", the focal region generally corresponds to the region at which the optical paths of light waves traveling through the gem 12 intersect or nearly intersect. The focal region is outside of the primary gem 12. Although nonlimiting, the distance between the focal region and the flat bottom 20 of the faceted gem 12 may be from about 0.001 cm to about 10 cm, from about 1 cm to about 9 cm, from about 2 cm to about 8 cm, about 5 cm and the like. The particular distance may vary depending on the needs of the user, the size of the gem and the refractive index of the gem 12.

In various nonlimiting embodiments, the colored object 14 placed in the focal region is a typographical symbol such as a letter, multiple letters, a corporate symbol or logo, a picture and the like. In some embodiments the colored object 14 is a colored geometric shape such as but not limited to a circle, a sphere, a cylinder, a square, a cube, a triangle, a pyramid, a polygon and the like. In other embodiments the object 14 placed in the focal region includes one or more gems, such as colored gems. In some embodiments, a chipped gem or less desired gem fragments are used as the colored gem(s). Examples of colored gems are any gems known in the jewelry arts or cited in jewelry publications and may be the same or different than the primary gem 12. The colored gem or colored object 14 may be an imitation gem such as a colored stone or colored molded plastic. In other embodiments, objects may be substrates colored with one or more inks.

The angle of the facet surface is determined based on the gem media, or the refractive index of the gem 12, the desired display and the desired focal region. Thus, optical path vectors may be used to determine the appropriate facet angle. Once determined, the facet 22 is cut and polished according to techniques well known in the jewelry arts. Jewelry faceting machines are commercially available through a variety of suppliers. Thus a variety of facets 22 may be cut depending on the desired positioning of the focal region and the refractive index of the primary gem 12.

III. Methods of Manufacturing the Gemstone Setting

The gemstone setting 10 of the present invention is formed by providing a substantially transparent primary gem 12, assigning a focal region outside of the primary gem 12, positioning a colored object(s) 14 to be projected or viewed as a plurality of images within the focal region, cutting the bottom of the primary gem 12 flat, faceting the top of the primary gem 12 such that the majority or preferably each facet 22 displays an image corresponding the colored object 14 or portion thereof, and positioning the primary gem 12 such that a plurality of images may be viewed when viewing the gem 12. The methods described herein may be practiced by one skilled in the jewelry arts.

As can now be envisioned by one skilled in the art to which the present invention belongs, any substantially transparent gem may be used with the present invention as a primary gem 12. Gems may be obtained from any suitable source such as found in nature or purchased from a seller. The gems may require tumbling and polishing to obtain the substantially transparent form.

A focal region is determined such that the majority or preferably, each of the facets 22, will display an image corresponding to an object 14 placed within the focal region. The focal region may vary depending on the size or chemical composition of the gem 12. As general guidance the focal region is vertically below the primary gem 12 and may include a horizontal area or vertical area of about 75%, 50%, 25%, 10%, 5%, or 1% of the area of the gem's flat bottom 20. The distance of the focal region from the flat bottom 20 may vary but includes from about 0.001 cm to about 10 cm, from about 1 cm to about 9 cm, from about 2 cm to about 8 cm, about 5 cm and the like.

The plurality of images includes a projected or reflected image that corresponds to the colored object(s) 14 positioned within the focal region. Thus, the colored object 14 may be any object that results in a desired plurality of images and should not be colorless. In some embodiments the object 14 is one or more gems. Each facet 22 may display an image corresponding to all gems, fewer than all gems, a portion of one or more gems, spacing between the gems and the like. The object 14 may fixed in position by permanently attaching the object 14 to a structural casting or setting structure 16. In some embodiments the object 14 is retained by prongs positioned within the structural casting 16. In other embodiments, the object is fused or soldered directly to the structural setting 16 itself. In other embodiments, the object is glued or adhered to a set of prongs or the structural setting 16. In still other embodiments the object(s) 14 is interchangeable allowing multiple objects 14 to be selectively inserted or removed according to the individual's desires. When multiple objects 14 are positioned within the focal area, a variety of alignment configurations may result in a variety of displayed images.

The bottom of the primary gem 12 is cut flat to prevent or reduce reflection of light within the gem 12. In the preferred embodiment there is not a faceted pavilion. However in some embodiments a faceted pavilion is also provided. Tools and methods of cutting gemstones to produce a variety of surface features are well known in the jewelry arts. A variety of suppliers provide tumbling, cabbing, faceting and carving tools, which may be used to produce the gemstone settings 10 of the present invention.

The top or crown of the primary gemstone 12 is faceted to display a plurality of images corresponding to the colored object 14 positioned within the focal region. The faceting takes into account the particular media that is being faceted (or gemstone composition) in the form of its refractive index and the positioning of the focal region. The refractive index of a particular gem 12 may be researched in publications or determined using a refractometer. A table is provided as FIG. 11 for guidance, and is included as part of the present invention.

Refraction is the change in direction of a wave, such as a light wave due to a change in its speed. This is most commonly seen when a wave passes from one medium to another. In the present invention a light wave passes from air to the primary gemstone 12. Snell's law is a formula used to describe the relationship between the angles of incidence and refraction when referring to light waves passing through a boundary between two different isotropic media, such as air and the gemstone 12. In essence, the law says that the ratio of the sines of the angles of incidence and of refraction is a constant that depends on the media. More specifically, the ratio of the sines of the angles of incidence and refraction is equal to the ratio of velocities in the two media, or equivalently to the inverse ratio of the indices of refraction:

$$\frac{\sin\theta_1}{\sin\theta_2} = \frac{v_1}{v_2} = \frac{n_2}{n_1} \quad \text{(Equation 1)}$$

$$n_1 \sin\theta_1 = n_2 \sin\theta_2 \quad \text{(Equation 2)}$$

Thus, when determining the angle of each facet 22, the optical path vector is considered. The optical path vectors are paths in which rays of light will pass through air and the primary gem 12. The optical path vector depends on the refractive index of the primary gem 12 and therefore may be used to determine the appropriate facet angle.

The top of the primary gem 12 is faceted to display a plurality of images. The plurality of images includes projections or viewed images that correspond to an object 14 positioned beneath the primary gem 12 within a defined focal region such that the facet 22 may focus on the object, or portion thereof. Each facet angle may be calculated and cut such that each facet 22 focuses on the object(s) 14 placed in the focal region. In embodiments where there are more than one object 14 placed in the focal region, each facet 22 may focus on at least one of a single object 14, more than one object 14, spacing around or spacing in between the objects 14. The primary gem 12 may be facetted such that the right portion of the faceted top focuses on a left portion of the focal region and the left portion focusing on a right portion of the focal region.

The primary gemstone 12 is secured to the structural casting or setting structure 16 after securing the colored object 14. The primary gemstone 12 is positioned above the colored object 14. The primary gemstone 12 may be secured using any technique known in the jewelry arts such as positioning within a set of prongs, gluing the gem 12 with jeweler's adhesive and the like.

EXAMPLES

The examples provided herein are for illustration of the instant invention and are not intended to limit the scope of the disclosed invention. It will be understood that various omissions, modifications, substitutions and changes in the forms and details of the gemstone setting described herein and in its operation can be made by those skilled in the art without departing in any way from the spirit of the present invention.

Example 1

Faceting a Gemstone to Display a Plurality of Images

The following example demonstrates the faceting of a gemstone to display a plurality of images. The example uses the refraction index associated with a diamond. Referring to FIG. 12, the gem is to be faceted such that three facets focus on a focal region E. Other gems may be substituted using their corresponding refraction index.

Figure 13:
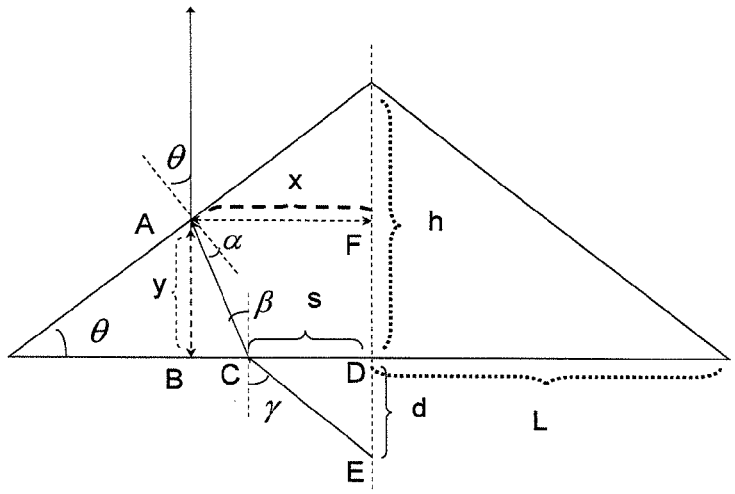
FIG. 13 is an image depicting methods of determining the desired facet angle using trigonometry.

Referring to FIG. 13, light comes out of the gem from point A. We define the position of A by measuring distance from A to center, AF=x, from A to the bottom line, AB=y. and angle of triangle is θ, we calculate DE=d assume we know x, y and θ. Using sin θ=n sin α we obtain $$\alpha=\sin^{-1}(\sin\theta/n) \quad \text{(Equation 3)}$$

$$\beta=\theta-\alpha \quad \text{(Equation 4)}$$

$$\gamma=\sin^{-1}(n\sin\beta) \quad \text{(Equation 5)}$$

$$s=x-y\tan(\beta) \quad \text{(Equation 6)}$$

$$d=s/\tan(\gamma) \quad \text{(Equation 7)}$$

Now referring to FIG. 12, AB, BC, CD are three facets tilted at different angles. BB'=⅔*AA', CC'=⅓*AA'. Now calculate the angle $\theta_1$, $\theta_2$, $\theta_3$ so the light comes out vertically from the edge of the three facets, i.e., point A, B and C.

| | | | | |
|---|---|---|---|---|
| index n | 2.417 | 2.417 | 2.417 | |
| point | A | B | C | D |
| x | 5 | 3.333333 | 1.666667 | |
| y | 0 | 0.897407 | 1.547212 | 1.886299 |
| theta | 28.3 | 21.3 | 11.5 | |
| alpha | 11.31176 | 8.64374 | 4.731458 | |
| beta | 16.98824 | 12.65626 | 6.768542 | |
| gamma | 44.92559 | 31.97627 | 16.55076 | |
| s | 5 | 3.131814 | 1.483034 | |
| d | 5.01301 | 5.016576 | 4.990407 | |

The gem used is a diamond. Referring to the table provided as FIG. 11, the refractive index n is 2.417. Assume AA'=5 cm, so x of A is $x_A$=5, y of A is $y_A$=0 since it's on the bottom line.

Then try different number for $\theta_1$ so the d will be close to 5 cm if one wants to put the object 5 cm below the stone. We found 28.3 for $\theta_1$ in the above table. Since BB'=⅔*AA' we found x of B is $x_B$=3.33333, y of B is $y_B=y_A+5/3\times\tan(\theta_1)$=0.897407. Put them in the second column of the table corresponding to x, y. Then try theta to have d close to 5. We found 21.3 degrees for $\theta_2$. Since CC'=⅓*AA', then x of C is $x_c$=1.66666, y of C is $y_C=y_B+5/3\times\tan(\theta_2)$=1.547212. And try theta to find d=5. We found 6.95 degrees for $\theta_3$.

One skilled in the art to which the present invention belongs would be able to adapt the examples, methods and compositions provided above for other gems, and are herein incorporated by reference.

What is claimed is:

1. A method of producing a gemstone setting comprising:

a) providing a substantially transparent primary gem and a set of four colored objects, wherein the primary gem comprises a flat bottom;

b) assigning a focal region beneath and remote from the primary gem in an opaque, metallic structural casting;

c) determining a plurality of facet angles that optically align each of a plurality of facets positioned around the primary gem with the assigned focal region such that:

i) a plurality of optical path vectors are directed through the primary gem and to the assigned focal region, and ii) each object positioned within the focal region is displayed as a plurality of images through the primary gem;

d) fixedly positioning the four colored objects along a plane within the structural casting;

e) faceting the top of the primary gem according to the plurality of facet angles to form the plurality of facets; and f) mounting the primary gem to the structural casting, wherein the primary gem is mounted above and at a distance from the four colored objects to position the colored objects in the focal region thereby displaying in at least one orientation a plurality of images corresponding to each colored object through the primary gem.

2. The method according to claim 1, wherein the four colored objects are positioned in a square configuration, further wherein the plurality of facets form four distinct viewing orientations through the primary gem, the orientations comprising:

i) a first orientation, wherein a majority of facets display only a first of the four colored objects;

ii) a second orientation rotated counterclockwise from the first orientation, wherein the majority of facets display only a second of the four colored objects;

iii) a third orientation rotated counterclockwise from the second orientation, wherein the majority of facets display only a third of the four colored objects; and iv) a fourth orientation rotated counterclockwise from the third orientation, wherein a majority of facets display only a fourth of the four colored objects.

3. The method according to claim 1, wherein the primary gem lacks a pavilion.

4. The method according to claim 1, wherein the focal region is from about 1% to about 25% of an area of the flat bottom.

5. The method according to claim 4, wherein the focal region is from about 5% to about 10% of the area of the flat bottom.

6. The method according to claim 1, wherein the step of determining a plurality of facet angles comprises, for each of the plurality of facet angles:

i) determining the refractive index of the primary gem;

ii) determining a position on the primary gem to form the facet angle;

iii) measuring a distance from the position to a center line of the primary gem;

iv) measuring a height of the position from the flat bottom;

v) measuring a distance from the flat bottom to the assigned focal region; and vi) calculating the facet angle such that each optical path between the focal region and facet exits the top of the primary gem vertically from the position.

7. The method according to claim 1, wherein the colored objects are interchangeable.

8. The method according to claim 1, wherein each of the facets is optically aligned to only a one colored object within the focal region, further wherein at least two facets are optically aligned to different colored objects.

9. A method of producing a gemstone setting comprising:

a) providing a substantially transparent primary gem and a set of colored objects, wherein the primary gem comprises a flat bottom;

b) assigning a focal region beneath and remote from the primary gem in an opaque structural casting;

c) determining a plurality of facet angles that optically align each of a plurality of facets positioned around the primary gem with the assigned focal region such that:

i) a plurality of optical path vectors are directed through the primary gem and to the assigned focal region, and ii) a first object positioned within the focal region is displayed as a plurality of images in a first rotational orientation through the primary gem and a second object positioned within the focal region is displayed as a plurality of images in a second rotational orientation through the primary gem;

d) fixedly positioning the colored objects along a plane within the structural casting;

e) faceting the top of the primary gem according to the plurality of facet angles to form the plurality of facets; and f) mounting the primary gem to the structural casting, wherein the primary gem is mounted above and at a distance from the set of colored objects to position the colored objects in the focal region, thereby displaying a plurality of images having a different color depending on viewing angle.

10. The method according to claim 9, wherein the primary gem lacks a pavilion.

11. The method according to claim 9, wherein the focal region is from about 1% to about 25% of an area of the flat bottom.

12. The method according to claim 11, wherein the focal region is from about 5% to about 10% of the area of the flat bottom.

13. The method according to claim 9, wherein the step of determining a plurality of facet angles comprises, for each of the plurality of facet angles:

i) determining the refractive index of the primary gem;

ii) determining a position on the primary gem to form the facet angle;

iii) measuring a distance from the position to a center line of the primary gem;

iv) measuring a height of the position from the flat bottom;

v) measuring a distance from the flat bottom to the assigned focal region; and vi) calculating the facet angle such that each optical path between the focal region and facet exits exits the top of the primary gem vertically from the position.

14. The method according to claim 9, wherein the colored objects are interchangeable.

15. The method according to claim 9, wherein each of the facets is optically aligned to only a one colored object within the focal region, further wherein at least two facets are optically aligned to different colored objects.

* * * * *